United States Patent [19]

Irons

[11] 4,165,497

[45] Aug. 21, 1979

[54] WIDEBAND RF SWITCHING MATRIX

[75] Inventor: Ronald E. Irons, Fairfax, Va.

[73] Assignee: Aiken Industries Inc., Alexandria, Va.

[21] Appl. No.: 850,500

[22] Filed: Nov. 11, 1977

[51] Int. Cl.[2] ..... H01P 1/10

[52] U.S. Cl. ..... 333/101; 179/18 GF; 333/104; 333/115

[58] Field of Search ..... 333/7 R, 7 D, 6, 10; 343/858; 340/147 CN, 166 R; 179/18 GF

[56] References Cited

U.S. PATENT DOCUMENTS

| | | | |
|---|---|---|---|
| 3,659,227 | 4/1972 | Whistler | 333/10 X |
| 3,737,686 | 6/1973 | Swanekamp et al. | 333/10 X |
| 3,813,497 | 5/1974 | Wachs et al. | 179/18 GF |
| 3,996,533 | 12/1976 | Lee | 333/7 R |

*Primary Examiner*—Paul L. Gensler

*Attorney, Agent, or Firm*—Oblon, Fisher, Spivak, McClelland & Maier

[57] ABSTRACT

An n×m wideband RF switching matrix constructed from modules which are interconnected by simple series paths. As many modules as required can be juxtaposed to form switching matrices of any order. Each module includes n inputs and a different lumped element directional coupler connected to each input, each directional coupler having a coupled output. Each module further includes a conductor coupled to a matrix output. The coupled outputs of the directional couplers on a given module are connected through single-pole, single-throw switches to the conductor. The direct outputs of the directional couplers are coupled to the inputs of the n directional couplers on the next module in the series.

5 Claims, 3 Drawing Figures

WIDEBAND RF SWITCHING MATRIX

BACKGROUND OF THE INVENTION

The present invention relates to a wideband RF switching matrix, and more particularly to such a matrix having improved circuitry interconnections.

Non-blocking RF switching matrices are well known in the art. Such matrices permit digital switching of RF signals from multiple sources, such as antennas, to multiple outputs, typically several receiver positions. At every matrix input there is a power divider having the same number of outputs as the matrix. Each divider distributes the input power equally between its outputs. At each matrix output there is a switch module having the same number of inputs as the matrix. Each output of a given divider is connected to an input of a given switch module. Connections between dividers and switch modules are made by a plurality of leads, such as cables, of varying length. These interconnections are confusing to assemble, leading to mistakes and malfunctions. Furthermore, the prior art assemblies are costly since substantial cabling is required. The cables are also a source of loss, particularly at high frequencies, and make phase uniformity difficult if not impossible. Moreover, temperature changes affect the cables of different lengths to different degrees, resulting in mis-matching. The different cable lengths give rise to variances in voltage standing wire ratios. These problems are particularly severe in sophisticated high frequency applications, and where large numbers of dividers and switch modules must be interconnected in a manner that they are non-blocking, i.e., all outputs useable simultaneously for signals from any one input.

SUMMARY OF THE INVENTION

Accordingly, one object of this invention is to provide an improved wideband RF switching matrix.

It is another object to provide such a switching matrix in which packaging is simplified by the elimination of complicated cross-connections.

It is a further object to provide such a switching matrix wherein the need for separate power divider and switch modules is eliminated.

It is yet another object to provide such a switching matrix in which electronic switch design is simplified.

The objects of the present invention are achieved by a wideband RF switching matrix comprising one or more cascaded modules. Each module has the form of an $n \times 1$ matrix and includes a plurality of input conductors, an output conductor, a plurality of lumped element directional couplers associated respectively with the input conductors for tapping off part of the signal power applied to the input conductors, and a plurality of switches associated respectively with the directional couplers for providing selectively closable signal paths from the coupling output port of the directional couplers to the output conductor. Connections between modules are simple series paths. Since there is no need for separate switch units, the multiplicity of connections and crossovers of the prior art is completely obviated.

Among the advantages of the present invention is the increased output isolation afforded by the directional couplers so that the termination switches used in hybrid transformer type switching matrices can be eliminated along with the isolation amplifiers commonly employed at each matrix output. This latter feature improves the dynamic range of the output signals and further reduces costs. Additionally, since matrix outputs from the first group of cascaded modules will exhibit better dynamic range than subsequent outputs, switching matrices can be designed with superior dynamic range characteristics for selected matrix outputs.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
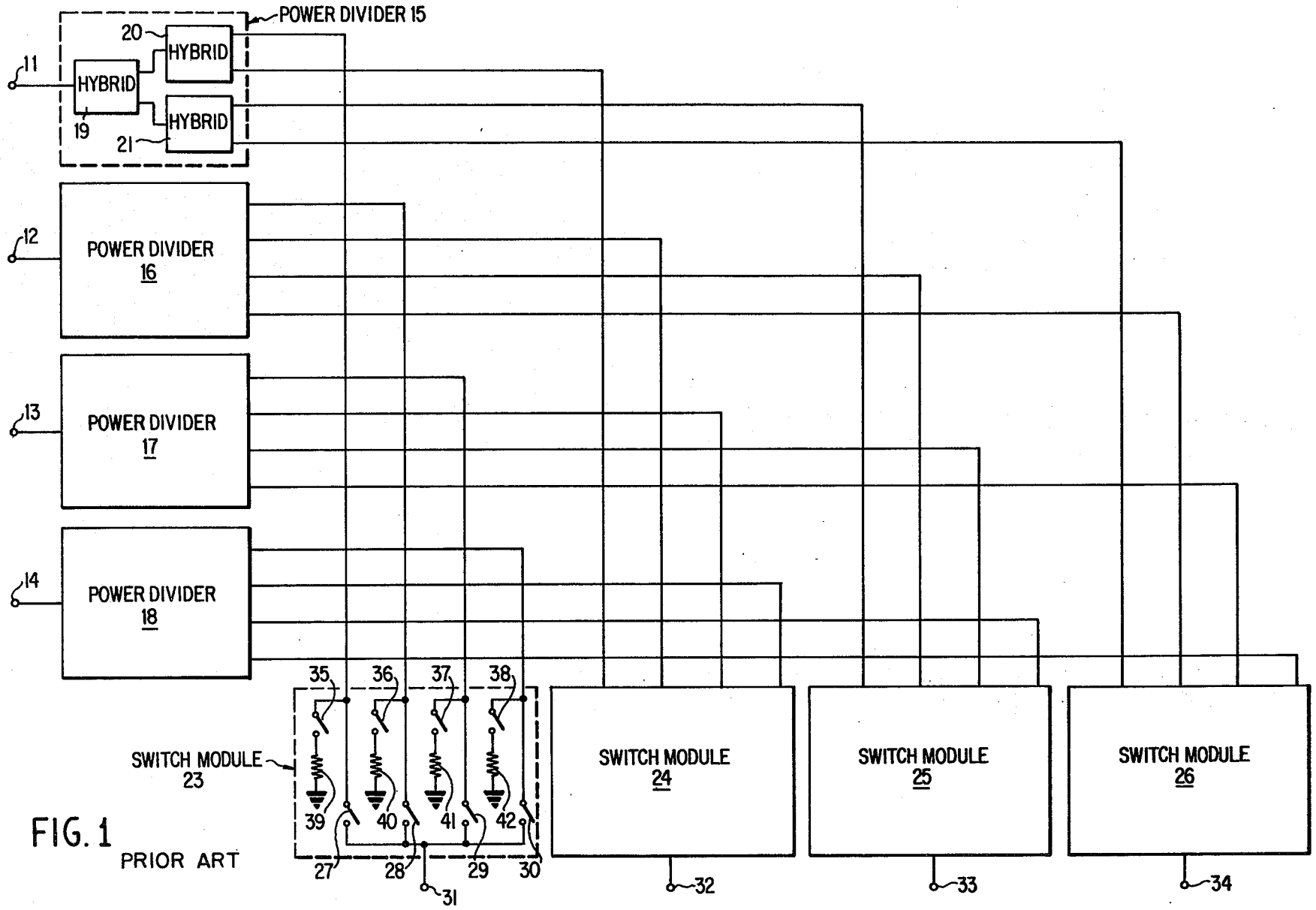
FIG. 1 PRIOR ART
FIG. 1 is a schematic diagram of a prior art switching matrix.

Referring now to the drawings, wherein like reference numerals designate identical or corresponding parts, and more particularly to FIG. 1 thereof, there is illustrated a prior art RF switching matrix of the type, for example, obtainable from Aiken C & E Division, Gaithersburg, Md., under the number RFM 0404. Although a $4 \times 4$ matrix is illustrated for convenience in the drawing, it is to be noted that such matrices need not be limited to any particular configuration. Each input 11–14 is connected to a power divider 15–18 having 4 outputs, each divider distributing the input power equally between its 4 outputs. Typically, the power divider comprises a plurality of hybrid transformers 19–21 as shown for power divider 15. At each matrix output there is a switch module 23–26 having 4 inputs. Each output of a given divider, 15, for example, is connected to the input of a different switch module 23–26 by means of a length of cable. Examining switch module 23 as illustrative of such units, series switches 27–30 provide switching necessary to connect any matrix input 11–14 to a desired matrix output 31–34. Input termination switches 35–38 and resistors 39–42 provide a matched load impedance for a power divider 15–18 when the respective series switch 27–30 is open. It is necessary that switches 27–30 be physically located as close to their common point of connection as possible in order to prevent undesirable impedance mismatches. This requirement normally dictates that each switch module 23–26 be constructed as a discrete component apart from the power dividers 15–18. As a result, a separate connection is necessary for every possible combination of an output of a power divider with an input of a switch module. The complexity of the interconnections is readily apparent from FIG. 1. As the size of the matrix is increased, these interconnections and their crossovers progressively increase and they can significantly complicate the construction and increase the cost of the switching matrix.

Figure 2:
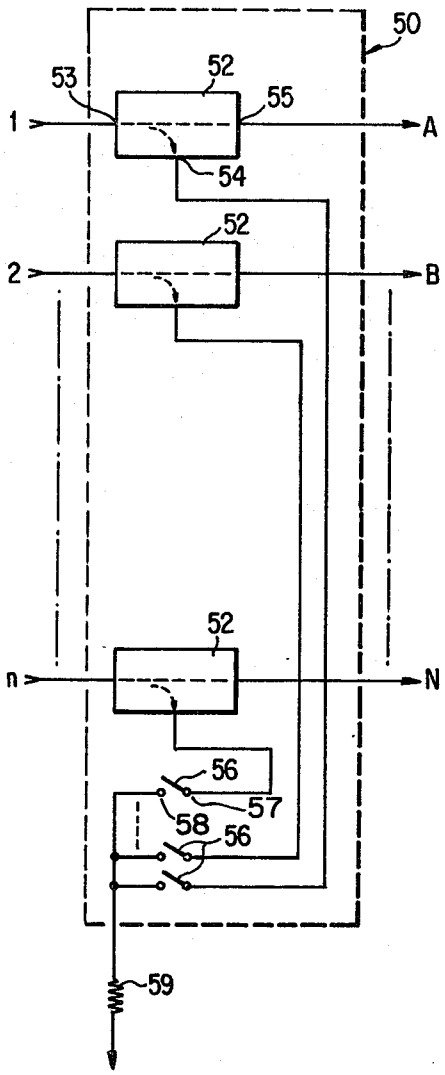
FIG. 2 is a schematic diagram of a first embodiment of a switching matrix in accordance with the principles of the present invention.

FIG. 2 is a schematic representation of a switching module according to the principles of the invention which can be used as a building block for higher order matrices or as an $n \times 1$ RF switching matrix. In this embodiment, the switching matrix 50 is preferably constructed on a printed circuit board and includes a plurality of input conductors 1, 2, . . . n and an output conductor 51. Associated with each of the input conductors is a power divider for receiving signal power applied to the input conductor and tapping off a part of the signal power. A lumped element directional coupler is used in preference to any other form of power divider, since it is capable of wideband operation, covering many octaves of the frequency band. Suitable directional couplers are well known in the art. One directional coupler which can be conveniently utilized to practice the invention is the Aikens C & E Division, Gaithersburg, Maryland H1001 directional coupler having a frequency range of 1–100 MHz. The directional coupler 52 has an input port 53, a coupled output port 54, a direct output port 55, and a terminated port (not shown) and is of the type that when an input signal is applied to port 53, a coupled output signal is produced at a port 54, a transmitted output signal is produced at port 55 and the terminated port is isolated so that no signal appears thereon. Conveniently, means 56 are associated with each directional coupler for providing a selectively closable signal path from its coupled output port 54 to the output conductor 51. While such means may take a variety of forms, it may take the form illustrated in FIG. 2 of a single-pole, single throw switch wherein one terminal 57 of the switch is connected to the coupled output port 54 of the directional coupler 52 and the other terminal 58 of the switch is connected to the output conductor, the latter point of connection being referred to as a cross-over point. In order to minimize insertion loss and to prevent high voltage standing wave ratios at high frequencies, it is preferable that the cross-over points be closely spaced so that the distance between switches 56 be short relative to a wavelength at the maximum frequency of operation. Suitable electronic switches are well known in the art. One switch which can be conveniently utilized to practice the invention is the Aikens C & E Division S5050 solid state HF/VHF switching element having a frequency range of 1–300 MHz. An attenuator, comprising resistance element 59 can be inserted, as shown, in the output conductor 51 to adjust the level of the output signal power in order to optimize the dynamic range and provide a better match to a receiver connected at the matrix output. Since the insertion loss of the directional couplers is low, a plurality of expansion output conductors A, B . . . N are conveniently connected to the direct output ports 55 of the directional couplers. The expansion output conductors provide high level signal outputs for driving additional RF switching matrices on separate printed circuit boards.

In operation, a closed path link is formed at any of the cross-over points by rendering conductive the switch 56 at the desired cross-over point. For example, let it be assumed that the signals on input conductor 2 are to be transferred to the output conductor 51. Thus, the switch associated with crossover point 2,51 is rendered conductive while the switches at all other crossover points are rendered non-conductive. It can be seen that the problem of multiple interconnections of cables has been completely obviated because the n×1 switching matrix can be constructed on a single printed circuit board.

Figure 3:
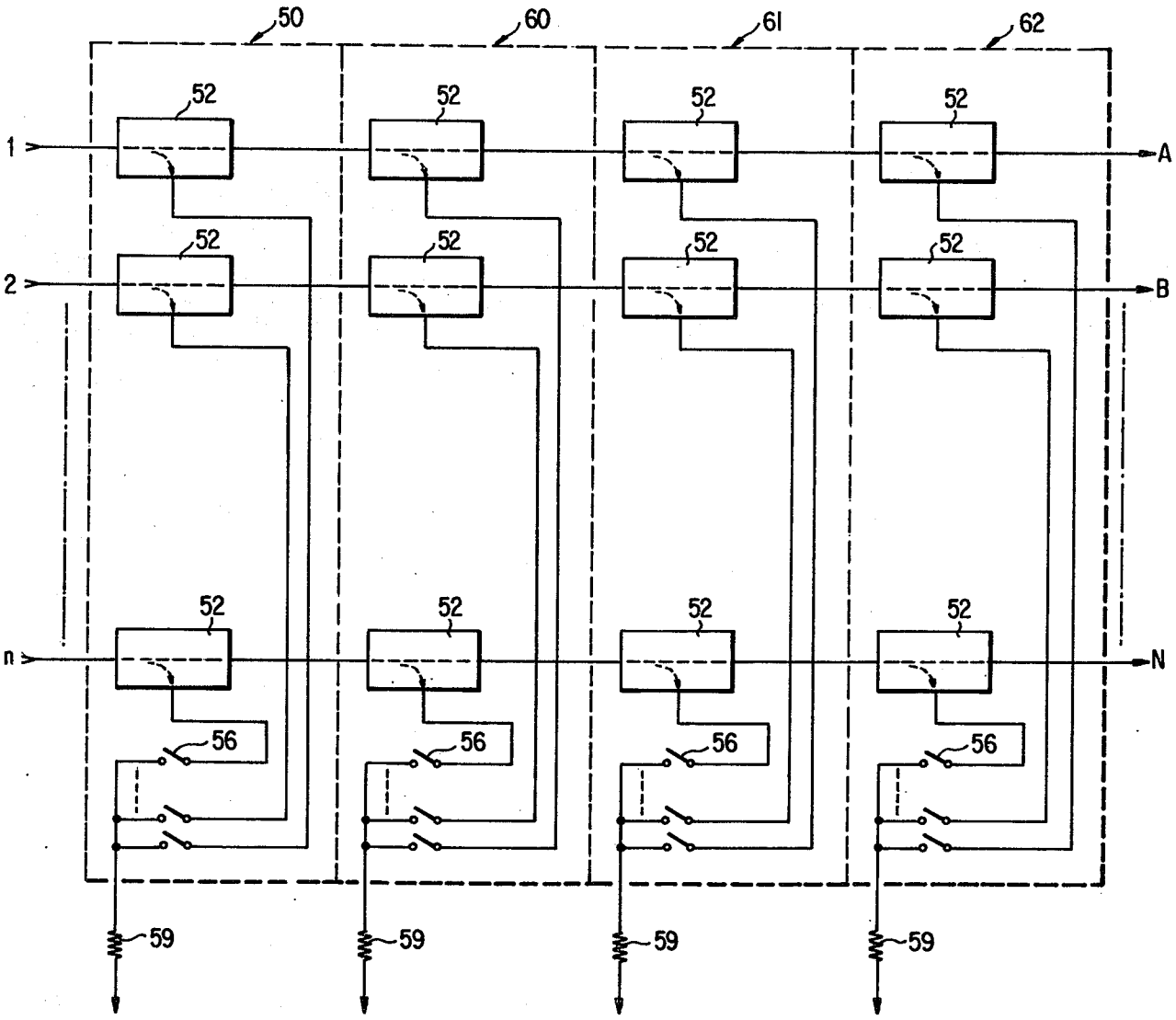
FIG. 3 is a schematic diagram of a second embodiment of a switching matrix in accordance with the principles of the present invention.

Referring to FIG. 3, there is illustrated one embodiment of the invention realized by cascading a plurality of n×1 switching matrices 50, 60, 61 and 62 on separate printed circuit boards to produce a switching matrix of higher order. This is achieved without the need for a multiplicity of connections and crossovers as in the prior art, by simply connecting the input conductors of each n×1 switching matrix in series to the respective expansion output conductors of the preceding n×1 switching matrix with short lengths of cable. Isolation between matrices is provided by virtue of the high isolation existing between directional coupler inputs and outputs and the interposition of isolation amplifiers is not necessary. The lines of the resulting n×4 matrix are again vertical and horizontal. As many n×1 matrices as required can be juxtaposed to form switching matrices of any order.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent in the United States is:

1. A wideband RF switching matrix comprising:
a plurality of input conductors;
an output conductor;
an equal plurality of lumped element directional couplers associated respectively with the plurality of input conductors, each lumped element directional coupler having an input port connected to a respective input conductor for receiving signal power applied to the input conductor, and a coupled output port for tapping off part of the signal power; and
an equal plurality of switching means connected to respective coupled output ports of the plurality of lumped element directional couplers for providing selectively closable signal paths from the coupled output ports to the output conductor.

2. The wideband RF switching matrix recited in claim 1 wherein:
the input and output conductors are coplanar.

3. The wideband RF switching matrix recited in claim 1 wherein the plurality of switching means includes:
a plurality of electronic switches, wherein the distance between switches is short relative to a signal wavelength at the maximum frequency of operation.

4. The wideband RF switching matrix recited in claim 1 including:
an attenuator connected to the output conductor.

5. A wideband RF switching matrix comprising:
a first plurality of input conductors;
a second plurality of output conductors;
a third plurality of lumped element directional couplers associated respectively with the plurality of input conductors, said third plurality forming groups of series-connected couplers, the first lumped element directional coupler of each group having an input port connected to a respective input conductor for receiving signal power applied to the input conductor, each lumped element directional coupler having a coupled output port for tapping off part of the signal power; and
a fourth plurality of switching means equal in number to the third plurality of directional couplers and connected to respective output ports of the third plurality of lumped element directional couplers for providing selectively closable signal paths from the coupled output ports to the output conductors.

* * * * *